US007855936B2

(12) United States Patent
Czarnek et al.

(10) Patent No.: US 7,855,936 B2
(45) Date of Patent: Dec. 21, 2010

(54) DIET WATCH

(75) Inventors: Robert Czarnek, Johnstown, PA (US); Sylvia D. Aruffo, Highland Park, IL (US)

(73) Assignee: Czarnek & Orkin Laboratories, Inc., Highland Park, IL (US)

( * ) Notice: Subject to any disclaimer, the term of this patent is extended or adjusted under 35 U.S.C. 154(b) by 64 days.

(21) Appl. No.: 11/953,901

(22) Filed: Dec. 11, 2007

(65) Prior Publication Data

US 2008/0137486 A1 Jun. 12, 2008

Related U.S. Application Data

(60) Provisional application No. 60/874,176, filed on Dec. 11, 2006.

(51) Int. Cl.
*G04B 47/00* (2006.01)
*G04F 8/00* (2006.01)
*G08B 23/00* (2006.01)

(52) U.S. Cl. ..... 368/10; 368/109; 340/573.1

(58) Field of Classification Search ..... 368/10, 368/107–110; 340/573.1, 573.7, 540, 686.1, 340/689; 434/127, 238, 247
See application file for complete search history.

(56) References Cited

U.S. PATENT DOCUMENTS 4,218,611 A * 8/1980 Cannon ..... 377/20
4,914,819 A * 4/1990 Ash ..... 30/147
4,975,682 A * 12/1990 Kerr et al. ..... 340/573.1
5,421,089 A 6/1995 Dubus et al.
5,424,719 A * 6/1995 Ravid ..... 340/573.7
5,563,850 A 10/1996 Hanapole
5,673,691 A * 10/1997 Abrams et al. ..... 600/300
5,685,722 A 11/1997 Taba
5,908,301 A 6/1999 Lutz
6,473,368 B1 10/2002 Stanfield
6,765,488 B2 7/2004 Stanfield
7,522,031 B2 * 4/2009 Lim ..... 340/309.16
2003/0065257 A1 * 4/2003 Mault et al. ..... 600/407
2005/0276164 A1 * 12/2005 Amron ..... 368/82

* cited by examiner

*Primary Examiner*—Vit W Miska
(74) *Attorney, Agent, or Firm*—The Webb Law Firm

(57) ABSTRACT

A diet watch includes a housing with an adjustable wristband attached thereto, at least one accelerometer disposed within the housing, a microcontroller disposed within the housing and operatively coupled to the accelerometer and a feedback device operatively coupled to the microcontroller. The accelerometer provides a signal indicative of an orientation of a user's hand in space. The microcontroller uses the signal from the at least one accelerometer to determine that a bite was taken by the user and starting a timer to countdown a preset time interval. The feedback device provides an indication to the user that another bite of food may be taken after the preset time interval has elapsed.

10 Claims, 4 Drawing Sheets

DIET WATCH

CROSS REFERENCE TO RELATED APPLICATION

This application claims priority from U.S. Provisional Patent Application No. 60/874,176, filed Dec. 11, 2006, the contents of which are incorporated herein by reference.

BACKGROUND OF THE INVENTION

1. Field of the Invention

The present invention relates, in general, to a device for modifying behavior and, more particularly, to a device for slowing an individual's rate of food consumption.

2. Description of Related Art

Research shows that eating too fast has adverse effects for persons who are trying to maintain or lose weight, as well as in discouraging interaction of family members at a dining table. Medical research has shown that it takes approximately 20 minutes from the time we first start eating for the brain to signal a person that he/she is full or have had enough to eat. If a person eats too fast we consume more food than is necessary before the brain sends a signal that informs the person that he or she is full. Therefore, a means of slowing the rate of food ingestion will greatly aid in a dieting regimen and weight reduction program.

Another consequence of eating too fast is that it reduces conversation among persons at a dining table. If people leave considerable time between taking bites of food, this provides a more relaxed "social atmosphere" at the dining table. Such a more relaxed atmosphere encourages table conversation.

Currently, several devices exist for monitoring food consumption. For instance, U.S. Pat. No. 5,421,089 to Dubus et al. discloses a fork with timer comprising a fork having a head, a plurality of spaced tines extended from the head, and a handle extended from the head remote from the tines; timer circuitry connected to the handle of the fork and adapted for providing a cue after an elapsed period of time for indicating to user that another bite of food using the fork may be taken; a replaceable power source connected to the fork and coupled to the timer circuitry with the power source adapted for energizing the timer circuitry; and a switch connected to the fork and coupled between the power source and the timer circuitry with the switch having one orientation for energizing the timer circuitry and another orientation for de-energizing the timer circuitry.

U.S. Pat. No. 5,563,850 to Hanapole discloses a device for mounting on the wrist of an individual that includes a motion-sensing element that is coupled to and starts a timing unit when the wrist is moved, as in raising a utensil of food to the mouth. The timing unit is coupled to a signal generator that it actuates after a given interval of time. The signal generator actuates an annunciator unit, in contact with the wrist of the individual that produces a tangible sensation on the wrist of the individual to advise the individual that it is time for more food, and that the cycle can be repeated. The tangible sensation may be a physical prodding or and electrical stimulus.

U.S. Pat. No. 6,765,488 to Stanfield discloses a portable device that helps a person control food consumption by slowing the eating process to a pace that provides time for the human brain to signal a "sensation of fullness" before over-eating or "binge eating" can occur. The device includes red and green lights, a circuit that controls energization of the lights and a pushbutton switch that operates a portion of a circuit. When the push button is depressed, the circuit energizes the red light for a predetermined wait period to indicate that the person should not eat. Then, the circuit energizes the green light to indicate that the person can take one or two bites of food at his/her convenience. After taking one or two bites, the person depresses the push button to cause the red light to be energized. This cycle continues until the meal is over.

However, each of the devices discussed above suffers from various drawbacks. For instance, a device such as the one disclosed by U.S. Pat. No. 5,563,850 utilizes only a simple tilt switch to detect the change of a single preset threshold. Such an approach is highly unreliable because it has no way in which to adapt to the physiology and/or habits of the user. It detects only a predetermined angle of the arm through a single axis of movement. Furthermore, devices such as the ones disclosed by U.S. Pat. Nos. 6,765,488 and 5,421,089 lack the ability to be discretely worn by the user.

Accordingly, a need exists for a device for monitoring the consumption of food that automatically starts a timer after each bite of food is taken based on the movement of a user's hand.

SUMMARY OF THE INVENTION

The present invention is directed to a diet watch including a housing with an adjustable wristband attached thereto, at least one accelerometer disposed within the housing, a microcontroller disposed within the housing and operatively coupled to the accelerometer and a feedback device operatively coupled to the microcontroller. The accelerometer provides a signal indicative of an orientation of a user's hand in space. The microcontroller uses the signal from the at least one accelerometer to determine that a bite was taken by the user and starting a timer to countdown a preset time interval. The feedback device provides an indication to the user that another bite of food may be taken after the preset time interval has elapsed.

The diet watch may further include a user interface having at least one button that allows a user to program the microcontroller. The at least one button may allow the user to set the preset time interval, to set the indication that the feedback device provides to the user or the like. The microcontroller may be programmable to be customized to distinct movement patterns of the user through threshold memorization based on feedback provided by the accelerometer. The feedback device may be a vibrator, buzzer, Light Emitting Diode (LED) or electric shock device. The feedback device may provide a signal to the user if the user attempts to take another bite of food before the preset time interval has elapsed.

The diet watch of the present invention may further include a display screen positioned on the housing for providing a visual indication to the user of relevant information. The display screen may be a liquid crystal display (LCD) or a light emitting diode (LED) display. The at least one accelerometer, which uses gravity as an input vector to determine the orientation of the user's hand in space, may be a two-axis accelerometer or a three-axis accelerometer.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE INVENTION

Figure 1:
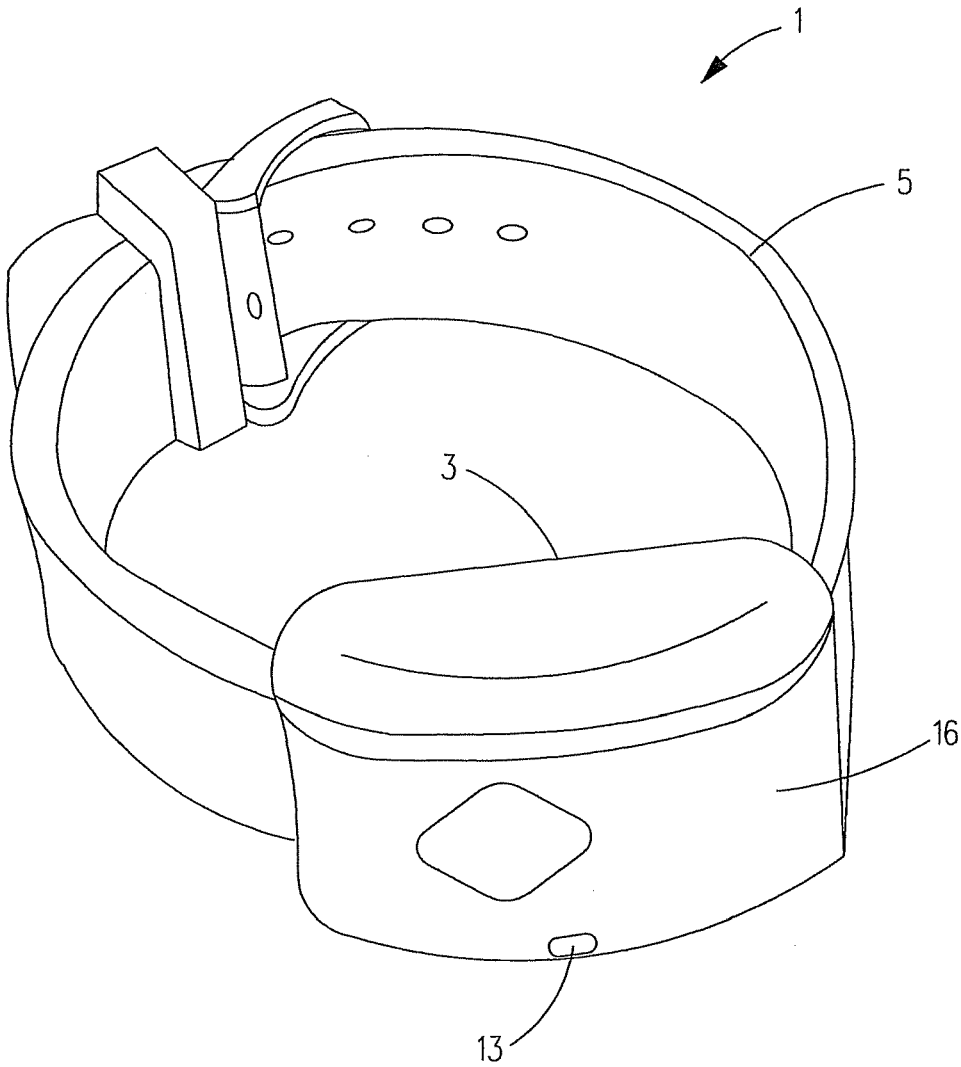
FIG. 1 is a photograph of a diet watch in accordance with the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
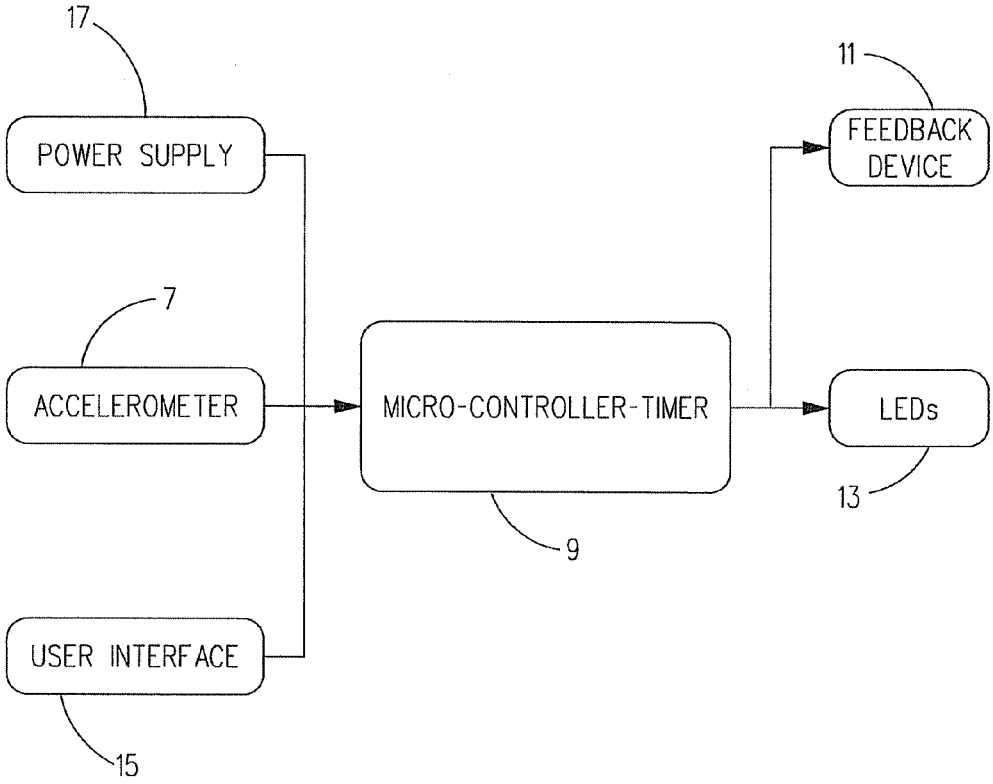
FIG. 2 is a block diagram illustrating the diet watch in accordance with the present invention.
Figure 3A:
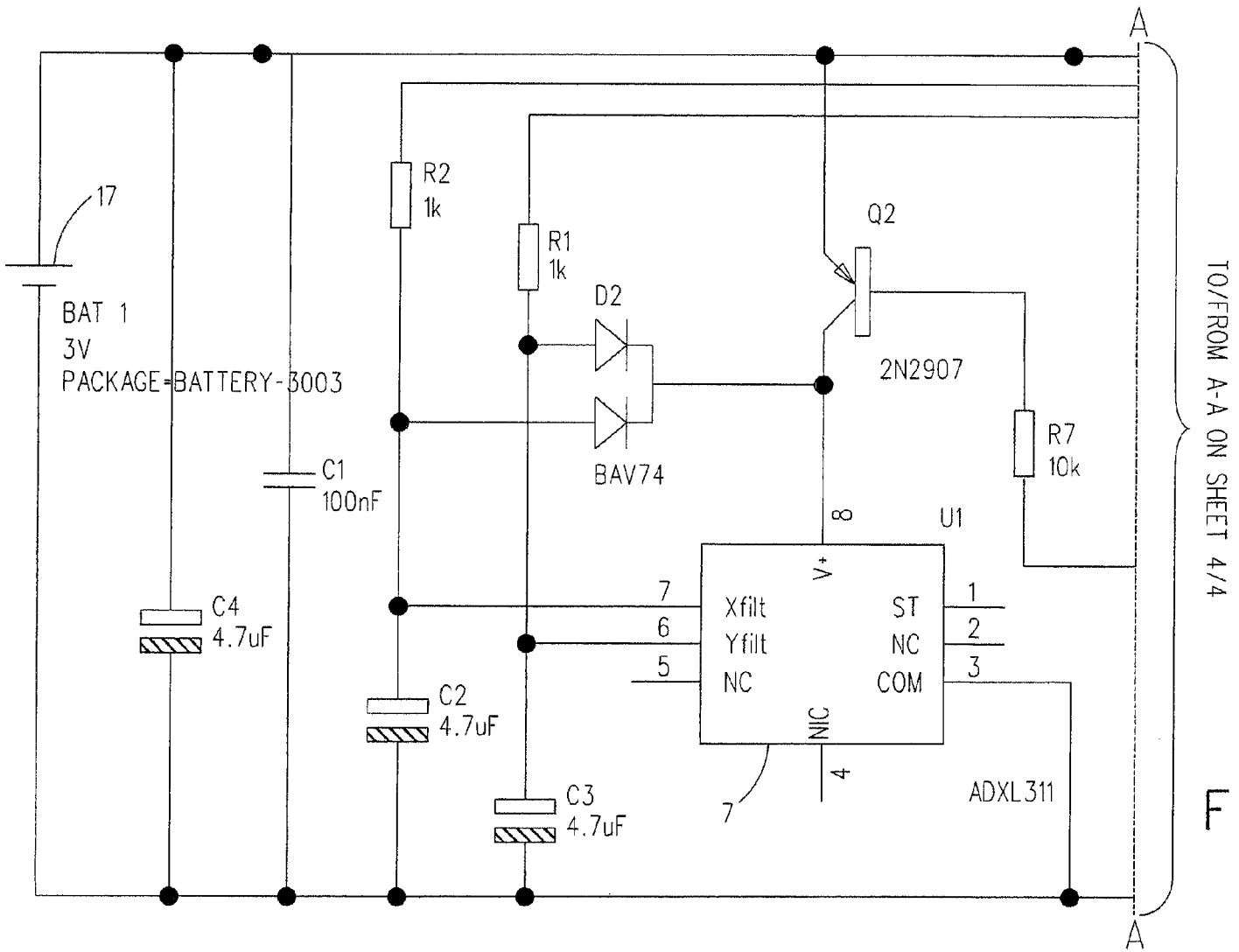
FIG. 3 is a detailed schematic diagram of the diet watch in accordance with the present invention.
Figure 3B:
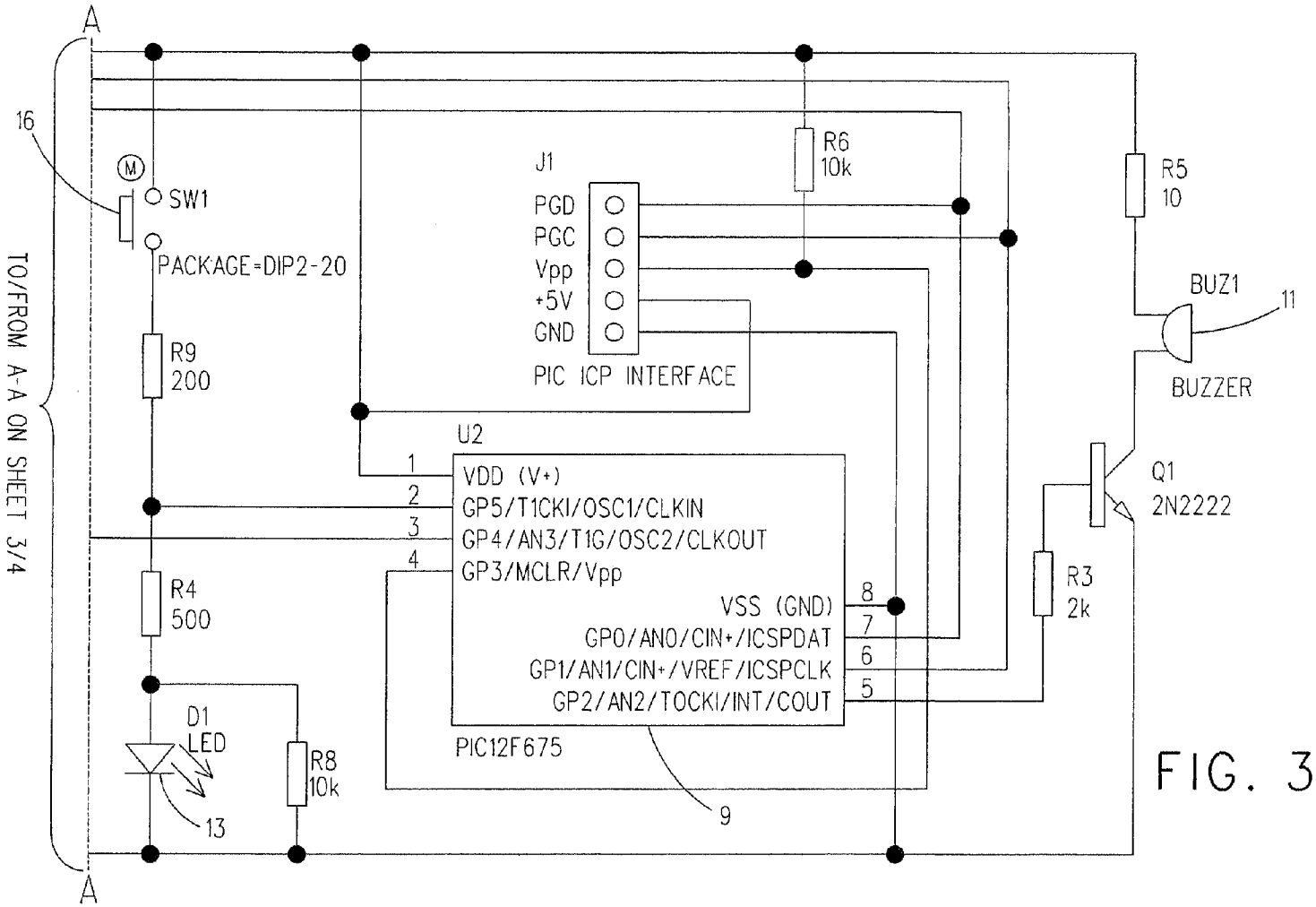

With reference to FIGS. 1-3, a diet watch 1 includes a housing 3 with an adjustable wristband 5 attached thereto. Adjustable wristband 5 may be any suitable band for attaching the device to the wrist of a user including, but not limited to, an elastic band, a band with a VELCRO fastening means, a band with a buckle-type fastening means or the like.

An accelerometer 7 is disposed within housing 3 to provide a signal indicative of an orientation of a user's hand in space. Accelerometer 7 uses gravity as an input vector to determine the orientation of the user's hand in space. Accelerometer 7 may be a two-axis accelerometer, such as the ADXL322 manufactured by Analog Devices, Inc., One Technology Way, P.O. Box 9106, Norwood, Mass. 02062 or a three-axis accelerometer, such as the ADXL330 manufactured by Analog Devices, Inc. or the SMB360 manufactured by Bosch Sensortec GmbH, Gerhard-Kindler-Strasse 8, 72770 Reutlingen, Germany.

A microcontroller 9 is also disposed within housing 3 and is operatively coupled to accelerometer 7. The use of an accelerometer 7, in combination with microcontroller 9, allows diet watch 10 to determine that a bite has been taken regardless of the type of motion the user implements while eating. Eating with a fork or spoon is a complex series of motions that depend on individual physiology. For example, one use of a fork requires a stick motion into a morsel of food, a wrist turn and an arm lift to the mouth. The use of a spoon, by contrast, has a scooping initial move followed by a much smaller angle of wrist turn to avoid a spill and a different angle to the mouth as the user's head lowers much further to meet the spoon. The use of accelerometer 7 coupled to microcontroller 9 allows diet watch 1 to monitor both wrist and arm movement accurately. Accelerometer 7 is a device that continuously measures components of acceleration vector. Microcontroller 9 calculates vector direction and compares vector variations with variables set by the user. In this manner, the user can program diet watch 1 to accurately determine when the motion of the user's arm corresponds to a bite of food being taken and when diet watch 1 should ignore the movement of the arm.

Diet watch 1 also includes a feedback device 11 disposed at least partially within housing 3 and is operatively coupled to microcontroller 9. Feedback device 11 provides an indication to the user that another bite of food may be taken. Feedback device 11 may be, but is not limited to, vibrator, buzzer, Light Emitting Diode (LED) or electric shock device. Feedback device 11 may also be configured to provide a signal to the user if the user attempts to take another bite of food before the preset time interval has elapsed.

Diet watch 1 further includes at least one LED 13 disposed at least partially within housing 3 and operatively coupled to microcontroller 9. LED 13 provides information to the user of the mode of operation of diet watch 1. For instance, LED 13 may be capable of emitting green and red light. When LED 13 is emitting a green light, the user may take a bite of food; and when LED 13 is emitting a red light, the user is provided with an indication that a bite of food should not be taken.

Diet watch 1 also includes a user interface 15 having at least one button 16 that allows a user to program microcontroller 9. The at least one button 9 may allow the user to set a preset time interval, set the indication that the feedback device provides to the user or the like. An LCD display (not shown) may also be incorporated into housing 3 to provide the user with a visual indication of such items including, but not limited to, the preset time interval or the like. Diet watch 1 further includes a power supply 17 for providing power to each component of the device. Power supply 17 may be any suitable power supply such as, but not limited to, a disposable battery, a rechargeable battery or the like.

In operation, the user first programs microcontroller 9 using user interface 15 to customize diet watch 1 to distinct movement patterns of the user's aim and wrist through threshold memorization based on feedback provided by accelerometer 7. Accelerometer 7 provides a signal indicative of an orientation of a user's hand in space. Microcontroller 9 uses the signal from accelerometer 7 to determine that a bite of food was taken by the user. Microcontroller 9 then starts a timer to countdown a preset time interval. Once the preset interval has elapsed, feedback device 11 provides an indication to the user that another bite of food may be taken. Feedback device 11 may also be configured to provide a signal to the user if the user attempts to take another bite of food before the preset time interval has elapsed. In this manner, diet watch 1 has the ability to slow the rate of food consumption of a user.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A diet watch comprising:

a housing with an adjustable wristband attached thereto;

at least one accelerometer disposed within the housing, said at least one accelerometer responsive to movement of a user's hand in space for outputting at least two signals related to components of acceleration in at least two directions;

a microcontroller disposed within the housing and operatively coupled to the at least one accelerometer for using the signals from the at least one accelerometer to determine that a bite was taken by the user and starting a timer to countdown a preset time interval; and a feedback device operatively coupled to the microcontroller for providing an indication to the user that another bite of food may be taken after the preset time interval has elapsed.

2. The diet watch of claim 1, further comprising a user interface having at least one button that allows a user to program the microcontroller to determine when the motion of the user's arm corresponds to the bite being taken by the user and when to ignore movement of the arm.

3. The diet watch of claim 2, wherein the at least one button allows the user to set the preset time interval, to set the indication that the feedback device provides to the user or any combination thereof.

4. The diet watch of claim 1, wherein the microcontroller is programmable to be customized to distinct movement patterns of the user through threshold memorization based on feedback provided by the accelerometer.

5. The diet watch of claim 1, further comprising a display screen positioned on the housing for providing a visual indication to the user of relevant information.

6. The diet watch of claim 5, wherein the display screen is a liquid crystal display (LCD) or a light emitting diode (LED) display.

7. The diet watch of claim 1, wherein the at least one accelerometer is a two-axis accelerometer or a three-axis accelerometer.

8. The diet watch of claim 1, wherein the accelerometer uses the force of gravity as an input vector to determine the orientation of the user's hand in space.

9. The diet watch of claim 1, wherein the feedback device is a vibrator, buzzer, Light Emitting Diode (LED) or electric shock device.

10. The diet watch of claim 1, wherein the feedback device provides a signal to the user if the user attempts to take another bite of food before the preset time interval has elapsed.

* * * * *